US006218027B1

(12) United States Patent
Yuse et al.

(10) Patent No.: US 6,218,027 B1
(45) Date of Patent: Apr. 17, 2001

(54) STEEL MATERIAL EXCELLENT IN CORROSION RESISTANCE AND FABRIC USING THE SAME

(75) Inventors: Fumio Yuse; Takenori Nakayama, both of Kobe; Toshiaki Kan, Kakogawa, all of (JP)

(73) Assignee: Kabushiki Kaisha Kobe Seiko Sho (Kobe Steel, Ltd), Kobe (JP)

( * ) Notice: Subject to any disclaimer, the term of this patent is extended or adjusted under 35 U.S.C. 154(b) by 0 days.

(21) Appl. No.: 09/384,340

(22) Filed: Aug. 27, 1999

(30) Foreign Application Priority Data

Feb. 25, 1999 (JP) ..... 11-047953

(51) Int. Cl.[7] ..... B32B 7/00; C23C 22/50

(52) U.S. Cl. ..... 428/608; 148/247; 148/273; 148/277; 148/287; 428/613; 428/628; 428/629; 428/632; 428/633; 428/640; 428/684; 428/472.2

(58) Field of Search ..... 428/608, 613, 428/628, 629, 632, 633, 640, 684, 472.2; 148/247, 273, 277, 287; 245/1

(56) References Cited

U.S. PATENT DOCUMENTS 6,068,712 * 5/2000 Yamane et al. ..... 428/472.2

FOREIGN PATENT DOCUMENTS 58-25458 2/1983 (JP) .
6-93467 4/1994 (JP) .
6-241982 9/1994 (JP) .
6-264256 9/1994 (JP) .
2572447 10/1996 (JP) .
8-278245 10/1996 (JP) .
9-125224 5/1997 (JP) .
9-165647 6/1997 (JP) .
2699733 9/1997 (JP) .
10-330881 12/1998 (JP) .
11-71632 3/1999 (JP) .

OTHER PUBLICATIONS

T. Nakayama, Current Advances in Materials and Processes (210), vol. 11, No. 3, p. 454, "Effect of Alloying Elements on Corrosion Resistance of Painted Steels in Chloride environments," Mar. 3, 1998.

S. Takeshita, Current Advances in Materials and Processes (211), vol. 11, No. 3, p. 455, "Effect of Ti Content on Weldability and Corrosion Resistance," Mar. 3, 1998.

T. Nakayama, Current Advances in Materials and Processes (265), vol. 11, No. 6, p. 1110, "Effect of Titanium on Formation and Structures of Iron rust Species (β–, α–FeOOH)," Sep. 1, 1998.

Journal of Steel Structure, Jul. 20, 1998, pp. 838.

A leaflet of corrosion resistance steel in chloride Environments, 2 pages, Oct. 20, 1998.

* cited by examiner

*Primary Examiner*—Deborah Jones
*Assistant Examiner*—Robert R. Koehler
(74) *Attorney, Agent, or Firm*—Oblon, Spivak, McClelland, Maier & Neustadt, P.C.

(57) ABSTRACT

A steel suitable for a fabric with or without painting and has good corrosion resistance with reproducibility, even if the steel is composed mainly of ordinary carbon steel or low alloy steel, wherein the surface of the steel is coated with rust comprising one or more selected from Ti, Nb, Ta, Zr, V and Hf in the total amount of 0.01 wt % or more. In the steel, the fraction of α-FeOOH and an amorphous rust is 35 wt % or more, and the fraction of β-FeOOH is 20 wt % or less.

16 Claims, 3 Drawing Sheets

① Ti SULFATE SOLUTION + ADDITION OF $TiO_2$
② ADDITION OF $TiO_2$
③ ADDITION OF $TiO_2$
④ ADDITION OF TiC
OTHERS ARE CONTROLED BY Ti SULFATE SOLUTION

STEEL MATERIAL EXCELLENT IN CORROSION RESISTANCE AND FABRIC USING THE SAME

BACKGROUND OF THE INVENTION

1. Field of the Invention

The present invention relates to a steel material that has high corrosion resistance and is suitable for a fabric which is difficult to maintain and is used with or without painting, for example, a bridge; and a fabric using this steel material.

2. Related Art

Hitherto, a steel material used for bridge fabrics, for example, a traffic bridge in the environment which may easily be subjected to corrosion (which may be referred to chloride environment, hereinafter) by airborne salt from the sea or deicing salt, such as an area in mountains or a seaside area, has been painted and used to improve corrosion resistance. However, the painted coating necessarily deteriorates with the passage of time. Thus, in order to maintain corrosion resistance, it is necessary to repaint the steel material in a given cycle.

Recently, as such a bridge, there has been frequently used a small number main girder bridge, which has a few main girders and includes a 2-main girder bridge as a typical example, instead of a conventional large number main girder bridge. The small number main girder bridge has the following advantages over the large number main girder bridge: the amount of used steel materials (steel weight) and the number of bridge members can be reduced and further construction efficency is good, so as to contribute to environmental protection and shortening of a construction term. For such a small number main girder bridge, it has been demanded that costs and loads for maintenance after the construction of the bridge are reduced as much as possible and the life span of the bridge itself is prolonged.

Therefore, for steel materials used for fabrics such as steel towers and buildings including the above-mentioned small number main girder bridge, it has been demanded that high corrosion resistance is maintained. For example, it has been demanded that the maintenance after the construction of the bridge is unnecessary even if the steel materials are used without any painting in the environment which may easily be subjected to chlorides, or the steel materials are used with painting and the painted coating is deteriorated or damaged in the use.

In order to improve corrosion resistance of such steel materials, improving-techniques about its parent metal, i.e., steel have been hitherto proposed. A typical example thereof is a weathering steel comprising P: 0.15% or less, Cu: 0.2–0.6%, Cr: 0.3–1.25%, and Ni: 0.65% or less. As this weathering steel, the following 2 types are standardized: types according to JIS G 3114 (Hot-Rolled Atmospheric Corrosion Resistant Steels for Weld Use) and JIS G 3125 (Superior Atmospheric Corrosion Resistant Rolled Steel). This weathering steel has such a self corrosion resisting function that rust generated on the surface of the steel in use of the steel becomes protective and this protective rust layers (weathering rust) having high atomospheric corrosion resistance by the above-mentioned elements in very small amounts. By such a property, the weathering steel is used mostly without any painting, as a maintenance-free construction material for various fabrics, for example, the above-mentioned bridge.

In the chloride environment, however, the protective rust layers, which characterize the weathering steel, are not easily formed by the influence of chloride. If the protective rust layers are not formed, the corrosion resistance of the weathering steel is remarkably lowered. This is based on the fact that the corrosion of the steel results in a drop in pH inside the rust layers in the chloride environment. That is, even if corrosion of the steel occurs slightly, the pH at the surface of the steel is lowered by the reactions of $Fe \rightarrow Fe^{2+} + 2e^-$ followed by $Fe^{2+} + 2H_2O \rightarrow Fe(OH)_2 + 2H^+$ so that both pH inside the rust layers and pH at the interface between the rust layers and the steel are lowered. Once these pHs are lowered, the transport number of chlorine ions in the rust layers increases to keep electrical neutralization. Thus, the concentration of chlorine ions occurs at the interface between the rust layers and the steel. As a result, a hydrochloric acid atmosphere is produced around the interface to promote the corrosion of the steel. At the same time, the solubility of iron ions increases by the drop in pH inside the rust layers to result in the phenomenon of blocking the formation of the protective rust layers, which is a main point of corrosion resistance function of low alloy corrosion resistant steels such as weathering steel. Thus, the corrosion is accelerated.

Therefore, in order to prevent the drop in pH inside the rust layers, there is proposed a technique of making the surface of the weathering steel alkali to block the acceleration of the corrosion. More specifically, Japanese Patent Application Laid-Open (JP-A) No. 58-25458, Japanese Patent No. 2572447 and the like disclose a method of dispersing an oxide (chemical species)of Be, Mg, Ca, Sr, Ba or the like for making the surface of weathering steel alkaline into the steel beforehand and acting the chemical species at the same time of the corrosion reaction of the steel to suppress the drop in pH at the steel surface.

The method of adding such an oxide to block acceleration of corrosion is indeed advantageous from the standpoint of suppression of the influence of chlorides from the external environment. However, it is difficult or restrictive in the same way as in the above-mentioned weathering steel to form the protective rust layers themselves. As a result, sufficient corrosion resistance cannot be obtained under the actual conditions. It is also feared that the oxide added to the steel has a bad influence on weldability and/or strength.

For this reason, in order to improve the corrosion resistance of steel materials, there are proposed various treatment processes for promoting protective rust formation by subjecting the steel materials to surface treatment, instead of the above-mentioned method of adjusting the components or composition of steel materials. For example, JP-A-6-93467 discloses a method of covering the surface of steel with rust comprising $\alpha$-FeOOH containing 0.3 wt % or more of one or more elements selected from Cr, Cu, P and Ni, and painting an aqueous solution containing Cr, Cu, P or Ni onto the surface of the steel in order to form this rust.

JP-A-9-125224 discloses a method of covering the surface of steel with rust comprising hematite ($\alpha$-$Fe_2O_3$) of 30–200 $\mu$m in thickness by heat-treating the steel.

The methods in the prior art of forming the protective rust layers themselves by surface treatment or heat treatment of steel materials are notable methods from the standpoint that attention is paid to the components or the composition of the protective rust layers. Namely, the above-mentioned weathering steel or the oxide-dispersed steel contains alloying elements in large amounts so as to exhibit inevitably lower weldability at the time of processing the steel material or lower efficiency at the time of producing the steel material by melting, rolling or the like than that of ordinary steel.

Costs for producing the steel material are also high by the drop in production efficiency and the inclusion of relatively large amounts of the alloying elements. Besides, the drop in the weldability makes costs for construction using the steel material high. Accordingly, if there is a method wherein ordinary carbon steel or low alloy steel is used without using such a weathering steel to realize high corrosion resistance by adjusting the structure and/or the composition of the protective rust layers, this method has many advantages from the viewpoint of construction efficency and costs.

However, the inventors have found that when the rust comprising α-FeOOH containing 0.3 wt % of one or more selected from Cr, Cu, P and Ni, as disclosed in JP-A-6-93467, or the rust comprising hematite ($\alpha$-$Fe_2O_3$) as disclosed in JP-A-9-125224 is used without any painting in the chloride environment, or is used with painting and the painted coating is deteriorated or damaged, high corrosion resistance is not necessarily exhibited. The inventors have also found that this is caused by the facts that the rust layers cannot easily be produced and that even if chemical treatment or heat treatment is conducted for the production thereof, the reproducibility of the rust layers is not good.

Therefore, an object of the present invention is to provide a steel material that has high reproducibility and corrosion resistance and is suitable for fabrics used with or without painting even if the steel material belongs to ordinary carbon steel or low alloy steel.

SUMMARY OF THE INVENTION

A main aspect of the present invention is a steel material excellent in corrosion resistance, the surface of which is coated with rust comprising one or more selected from Ti, Nb, Ta, Zr, V and Hf in the total amount of 0.01 wt % (% by weight) or more, in which the fraction of α-FeOOH and an amorphous rust is 35 wt % or more, the fraction of β-FeOOH is 20 wt % or less, and each of the fractions is measured by X-ray diffraction.

According to the present invention, the rust generated on the surface of the steel material in use as a fabric can be made into protective even in the chloride environment. As a result, the steel material can have high corrosion resistance.

The inventors made investigations on the relationship between the structure and/or composition of the rust generated on the surface of steel material and the corrosion resistance in the chloride environment. As a result thereof, the inventors have found that high corrosion resistance can be exhibited with high reproducibility in the chloride environment by causing one or more selected from Ti, Nb, Ta, Zr, V and Hf (which may be referred to as Ti etc., hereinafter) to be comprised in the surface or the rust layers of steel material.

That is, the inventors have found that if one or more selected from Ti etc. is caused to be comprised in the surface or the rust layers of steel material, rust which is subsequently generated on the surface or in the rust layers of the steel material in the atmospheric environment is made into fine and dense α-FeOOH rust or amorphous rust by the inclusion of these elements even in chloride environment, and that the generation of β-FeOOH is sufficiently suppressed in this process.

The action of Ti etc. on the generation of the rust is presumed as follows. Ti etc. are turned into ions, fine compound particles or fine precipitation having colloidal properties (i.e., hydroxide, oxyhydroxide or oxide of Ti etc. generated by oxidation or hydrolysis of Ti, Ti ions etc., or reaction products thereof with other elements), so as to have an influence on the generation or growth of the rust. In this way, the crystal structure of the rust is disordered and the growth thereof is suppressed. Alternatively, defective sites of the rust are filled up. Such actions prevent the occurrence of the starting point of corrosion.

According to the result that the composition of the rust which comprises Ti etc. and is excellent in corrosion resistance is obtained by X-ray diffraction, fine α-FeOOH or amorphous rust is generated on the surface or in the rust layers of the steel material and further the production of β-FeOOH is sufficiently suppressed. It has been found that for these reasons especially high corrosion resistance in the chloride environment can be exhibited with good reproducibility. More specifically, the following (1), (2) and (3) contribute to the improvement in the corrosion resistance: (1) suppression of the generation of β-FeOOH, (2) an appropriate fraction of amorphous rust, and (3) an appropriate fraction of α-FeOOH. The order of the intensity of the contribution is (1)>(2)>(3). Particularly, effects by (1) and (2) are large.

That is, among rusts, the rust which preferably has 35 wt % or more of the fraction of α-FeOOH and amorphous rust and preferably has 20 wt % or less of the β-FeOOH rust can exhibit higher corrosion resistance with higher reproducibility in the chloride environment. However, the rust having a larger fraction of the amorphous rust exhibits higher corrosion resistance among rusts having the same fraction of α-FeOOH and amorphous rust. The condition that the fraction of β-FeOOH is low (preferably 20 wt % or less) contributes more largely to high corrosion resistance than the condition that the fraction of the α-FeOOH and amorphous rust is 35 wt % or more.

JP-A-6-93467 discloses that the component of the rust layers generated on the surface of steel material is preferably dense α-FeOOH. As described above, however, in order to exhibit high corrosion resistance with better reproducibility, it is more important that β-FeOOH is not present in the protective rust, that is, that the generation of β-FeOOH is suppressed as much as possible. Important features of the present invention are that β-FeOOH is not present, that even if β-FeOOH is present, the β-FeOOH does not have a bad influence on corrosion resistance, and that the generation or growth of β-FeOOH is suppressed as much as possible to promote the production of protective rust.

Although JP-A-6-93467 pays attention to α-FeOOH rust, the publication does not pay attention to the reason why high corrosion resistance is not necessarily exhibited when the steel material is used in the chloride environment or when the steel is used with painting and the painted coating is deteriorated or damaged. The reason why high corrosion resistance is not exhibited appears to be based on the generation of β-FeOOH in rust.

That is, if β-FeOOH, which easily promotes corrosion, is present even in the case that the percentage of the amorphous or α-FeOOH in rust is sufficiently high, β-FeOOH functions as a starting point to promote corrosion. This phenomenon is remarkable, in particular in the chloride environment. Therefore, the suppression of the generation of β-FeOOH is a key point for causing the protective rust layer to exhibit high corrosion resistance.

In the light of the above, in the steel material of the present invention, the percentage of the amorphous species or α-FeOOH is raised in rust generated in use of the steel material by causing one or more selected from Ti etc., in particular Ti, to be comprised in an amount of 0.01 wt % or more, preferably 0.05 wt % or ore, and more preferably 0.1 wt % or more in original rust. In this way, protective rust layers wherein the generation of β-FeOOH is suppressed are formed. As a result, high corrosion resistance is exhibited, in particular in chloride environment.

DETAILED DESCRIPTION OF THE PREFERRED EMBODIMENTS

Figure 1:
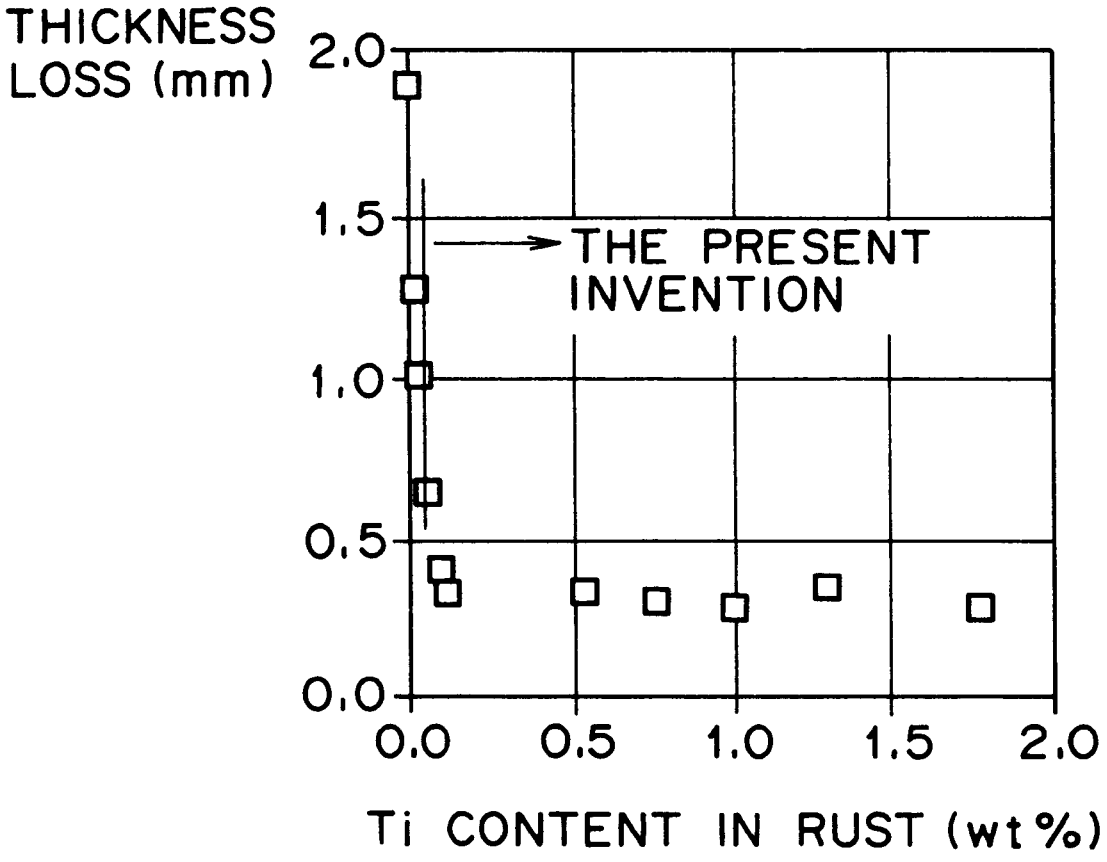
FIG. 1 is a graph showing the relationship between the Ti content in rust, defined in the present invention, and thickness loss.

First, the significances of Ti, Nb, Ta, Zr, V and Hf comprised in the rust in the present invention will be in detail described. In the steel material of the present invention, by causing one or more selected from Ti etc., in particular Ti, to be comprised in an amount of 0.01 wt % or more in the rust, the percentage of the amorphous species or α-FeOOH is raised in rust generated in use of the steel material so that protective rust layers wherein the generation of β-FeOOH is suppressed can be formed. As a result, high corrosion resistance is exhibited, in particular in the chloride environment. As the rust generated in use of the steel material is denser, the effect of blocking the invasion of corrosion factors such as chloride ions is stronger.

Although unclear are the mechanisms of effects based on the fact that the above-mentioned protective rust comprising Ti etc. is formed and the fact that the generation of β-FeOOH is suppressed, the mechanism are presumed as follows. (1) When parent iron is corroded and eluted, fine particles of carbide or nitride of Ti etc., which are generated in the steel, are discharged so that these particles function as nuclei of iron rust (FeOOH), and/or (2) when rust is generated so that the steel is eluted, Ti etc. are also eluted out as ions and these metal ions are made into fine colloid or hydroxide by oxidization or hydrolysis so that the resultant becomes nuclei of rust to be generated. That is, it appears that the nuclei themselves, described in the (1) and (2), block the generation or growth of crystalline rust, such as β-FeOOH rust, which is unstable and brittle and is easily exfoliated, so as to promote the formation of protective amorphous rust.

The effect of Ti etc. can be exhibited by causing one or more selected from these elements to be comprised in a total amount of 0.01 wt % or more, preferably 0.05 wt % or more, and more preferably 0.1 wt % in the rust. Even if the amount is over 50 wt %, the effect is not promoted. Under some condition of using the steel material, the adhesion between the rust and the surface of the steel material drops so that contrarily corrosion resistance may be lowered. Therefore, the upper value of the total amount is preferably about 50 wt %. As will specifically described later, the effect of improving corrosion resistance by Ti is highest. Accordingly, in the case that one or more of these elements are comprised in the rust, Ti is preferably essential. In the case that Ti is not comprised and one or more selected from Nb, Ta, Zr, V and Hf are comprised in the rust, it is preferred from the standpoint of exhibiting corrosion resistance certainly that the total amount of comprised elements is larger than the total amount in the case of setting Ti as a standard.

Elements other than Ti etc. comprised in the rust in the present invention may be comprised as impurities in the rust unless the elements block the effect of Ti etc. and the generation of the rust intended in the present invention. As other elements, one or more selected from Cr, Cu, P and Ni, which are disclosed in JP-A-6-93467, may be comprised. Although these elements cannot surely cause an improvement in corrosion resistance as described above, any combination of any one(s) [0.3 wt % or more] of these elements with Ti etc. may cause synergetic effect for contributing to conversion of the rust to amorphousness and suppression of the generation of β-FeOOH.

The following will describe the structure or the composition of the rust in the present invention. In the present invention, it is preferable that the main structure of the rust is amorphous and contains a smaller amount of β-FeOOH. In general, main structure of iron rust generated on the surface of steel are crystalline rusts made of α-FeOOH, β-FeOOH, γ-FeOOH and $Fe_3O_4$, and amorphous rust. Among these rusts, the amorphous rust is by far finer than the crystalline rusts and constitutes protective rust layer. Furthermore, even if "defects" are generated in the crystalline rusts in use of steel, the defects are repaired with the amorphous rust to reduce "the defects". Thus, the amorphous rust has a "defect repairing function". As a result, the corrosion resistance of the steel is ensured for a long time. As the percentage of the amorphous rust in iron rust is higher, the amount of β-FeOOH is smaller so that corrosion resistance is higher. As the percentage of α-FeOOH, which is the most stable among the crystalline rusts, is higher, corrosion resistance is higher. In the case that the steel is used with painting, the above-mentioned dense rust makes the adhesion between the steel and the painted coating good to ensure corrosion resistance of the steel for a long term. In the present invention, therefore, the fraction of the amorphous component and α-FeOOH in the rust generated on the surface of the steel material is preferably 35 wt % or more. The fraction is obtained by X-ray diffraction.

The other rusts, in particular, the crystalline rust such as β-FeOOH function as starting points of corrosion even if the percentage of the amorphous species is high in the rust. Thus, it is necessary that the generation of these rusts is suppressed as much as possible. In the present invention, therefore, the fraction of β-FeOOH in the rust generated on the surface of the steel material is preferably 20 wt % or less. The fraction is also obtained by X-ray diffraction. If the fraction of the amorphous rust component and α-FeOOH is less than 35 wt % and the fraction of β-FeOOH is more than 20 wt %, the percentage of crystalline and coarse rust components such as β-FeOOH, γ-FeOOH and $Fe_3O_4$ becomes large. As a result, the rust on the surface of the steel material is not made up to protective rust layers, so that high corrosion resistance of the steel material cannot be ensured.

The evaluation on the denseness of the rust generated on the surface of the steel material is also important as evaluation on corrosion resistance. As is well known, any actual corrosion resistance test requires much time. Thus, target steel materials cannot be evaluated for a short time. The inventors have found that the denseness of the rust can be evaluated by $N_2$ adsorption method and it is possible to evaluate a smaller pore size of the rust, which is measured by $N_2$ adsorption method, as denser rust.

The $N_2$ adsorption method, which is recommendable as a method for evaluating the denseness of the rust, is one of gas adsorption methods. In this method, an automatic volume adsorption device is used to obtain $N_2$ adsorption isotherms about pores of a porous material at liquid nitrogen temperature (77.4 K) and then the pore size and the pore size distribution of the pores are calculated and obtained from the $N_2$ adsorption isotherms by the t-plotting manner. This is a method that the size of pores of a porous material is obtained from Kelvin's equation on the assumption that nitrogen with liquid nitrogen temperature wets the surface of the pores completely. This method itself is known in, for example, "Chemistrys seminar-16, Adsorption Chemistry" (published on Jul. 30, 1991 by Maruzen).

In the present invention, the denseness of the rust generated on the surface of the steel material is the condensed state of the rust, and the condensed state (condensation degree) can be evaluated by the interval between grains of the rust. The inventors have also found that the interval between grains of the rust can be measured as the above-mentioned pore size by the $N_2$ adsorption. That is, the pore size measured using by the $N_2$ adsorption corresponds satisfactorily to the interval between grains of the rust. (This interval corresponds to the condensation degree of the rust.) Using the pore size, the rust can be analyzed as a three-dimensional (entire) fabric. The pore size of the rust, which is defined in the present invention, is substantially the pore size measured by the $N_2$ adsorption method, and is essentially the interval between grains of the rust.

As the pore size of the rust, which is measured by the $N_2$ adsorption, is smaller (that is, the rust is denser), corrosive materials make an invasion more difficultly into the rust so as to improve corrosion resistance more. From this viewpoint, in the present invention, the pore size of the rust is preferably 3 nm or less, more preferably 2 nm or less, and most preferably 1 nm or less. Ti etc. have a function of making the rust fine and dense. Therefore, in order to make the pore size smaller, it is preferable to increase the content of Ti etc. If the pore size of the rust is larger than the above-mentioned range, corrosive materials make an invasion easily so that corrosion resistance of the rust deteriorates.

The specific surface area that can be obtained by BET plotting in $N_2$ adsorption is also an index representing the denseness of the rust. In order to improve the corrosion resistance, the specific surface area is preferably 10 $m^2/g$ or more, and more preferably 50 $m^2/g$ or more. The grain size (crystallite size) of the rust, which is obtained by X-ray diffraction, is preferably 50 nm or less, and more preferably 20 nm or less.

The interval between grains of the rust can also be measured with a transmission electron microscope (TEM). According to the TEM manner, however, only data on local areas can be obtained. Thus, the rust cannot be grasped as a three-dimensional (entire) fabric. From this viewpoint, the TEM manner is inferior to the $N_2$ adsorption. In order to evaluate the rust on the surface of steel material with good reproducibility, it is necessary that many points are measured. Thus, there is a problem that much labor and time are necessary.

In the present invention, the corrosion resistance of the rust generated on the surface of the steel material means the corrosion resistance of the steel material in the chloride environment. Therefore, in order to ensure high corrosion resistance actually, it is necessary to evaluate corrosion resistance obtained from an atmosphere exposure test of the steel material, in particular, corrosion resistance of the steel material after being exposed to the atmosphere including sprayed salt water (e.g., spraying 0.1–5.0% salt water per week), which imitates the chloride environment.

As a manner for measuring the above-mentioned amorphous degree, X-ray powder diffraction is effective, which is disclosed in "Quantification of iron rust structure by X-ray powder diffraction, and application thereof" in "Proceedings of Japan Society of Corrosion Engineering's Corrosion '95 Meeting 95C-306 (pp. 341–344)". According to this document, weathering steel is a subject, and quantification of iron rust structure on the surface of the steel material is tried by X-ray powder diffraction. The document supports a corrosion resistance improving model in which protective rust layers become denser as the percentage (i.e., amorphous degree) of the amorphous rust component in iron rust is higher. The document describes the following as more specific X-ray powder diffraction. A sample of rust sampled from steel material is mixed with a given weight of $CaF_2$, ZnO or the like as an internal standard substance to prepare powder. The powder is identified by usual X-ray diffraction. From integration intensity ratios of respective peculiar diffraction peaks of the above-mentioned 5 kinds of rust and analytical curves of the respective rust structure which are beforehand obtained, the respective crystalline rust are quantitatively measured. The amounts of the respective crystalline rust are subtracted from the total amount of the rust to calculate the percentage of the amorphous. This is based on the fact that it is difficult to obtain the integration intensity ratio of the diffraction peak of the amorphous rust itself and thus analyze the amorphous rust quantitatively. According to the document, ZnO is highly reliable as an internal standard substance.

As is disclosed in the document, in other analyzing methods than X-ray diffraction, for example, infrared spectroscopic analysis, qualitative analysis of the rust structure is possible but quantitative analysis thereof is difficult. That is, quantitative analysis of the rust components is not established. In the present invention, therefore, the amorphous degree of the rust on the surface of steel material is quantitatively measured by X-ray powder diffraction, in particular X-ray powder diffraction using ZnO disclosed in the document as an internal standard substance.

The following will describe a method for forming dense and protective rust layers in the present invention. The surface of steel material before or in use as a fabric is subjected to an appropriate treatment such as washing, cleaning or surface polishing. According to the surface state required for the steel material, such a treatment may be appropriately selected from mirror finish, mere cleaning and the like. Of course, such a treatment may not be performed.

One or more selected from Ti, Nb, Ta, Zr, V and Hf are caused to be comprised or present in the surface or the rust layers of the steel material by, for example, a chemical method of applying, to the surface of the steel material, an aqueous solution or a blend solution containing ions, fine particles or fine compounds of one or more of Ti etc., or an aqueous solution Cr, Cu, P or Ni ion together with Ti etc., or a chemical method of immersing the steel material into such a solution or blend solution as above. In this case, it is preferred that the solution contains Ti ions or titanic ions since Ti has better effect for forming dense rust than the other elements. In the case that ions of these elements or acid ions of these elements are contained in the solution, sulfate or chloride of these elements are preferably used because of the stability of the solution, and the like. In the case of using fine particles or fine compounds of Ti etc., the average particle size thereof is preferably 50 nm or less, more preferably 25 nm or less, and most preferably 15 nm or less from the standpoint of the improvement in corrosion resistance. It is also preferable to use oxide, carbide, nitride, or complex compounds containing these compounds as a base. If the respective ions coexist with the fine particles or the fine compounds, more intense corrosion resistance is exhibited.

Concerning the chemical method, in order to bring the solution into contact with the surface or the rust layers of the steel material, the method of painting the solution onto the steel material is the simplest. According to circumstances, however, it is permissible to select appropriately a usual solution treating method, such as immersion of the steel material into the solution. In the case of using fine particles or fine compounds of Ti etc., Ti etc. in a solid form may directly be sprayed onto the surface or the rust layers of the steel material. From the viewpoint of adhesion and dispersion of Ti etc., it is preferable to make Ti etc. into a solution or a blend solution.

Methods other than the chemical method include gas phase coating in which Ti etc. is concentrated or comprised in the surface of the steel material by sputtering or vapor deposition; a method of using a steel which contains Ti etc. and keeps concentrated Ti etc. in its surface to form a steel surface which comprises Ti etc. and is a base for forming the dense and protective rust layers in the present invention.

According to a method of transferring the elements contained in the steel material into the rust by thermal diffusion, it is difficult to increase the amount of these elements in the steel material or the concentrated amount thereof in the surface. It is feared that such an increase causes other properties such as weldability and mechanical properties to be blocked. Even if such an increase is attained, it is difficult to cause a predetermined amount (more than the lower limit) of the elements to be comprised in the rust. The following advantage may be lost: ordinary carbon steel or low alloy steel can be used. In the gas phase coating, costs for facilities and processing are high. Moreover, this method is not effective for handling a great deal of steel plates having a large size. Thus, the realization of this method is difficult. Among these methods, therefore, the chemical method, which is simple and low-priced, is most preferable.

As described above, it is difficult that Ti etc. in the composition of the steel material covers the required amount of Ti etc. in the rust. As will be described in detail later, Ti etc. in the components of the steel material have a function of promoting the generation of dense and protective rust. In the case, solved Ti acts in the form of a Ti ion, and non-solved Ti acts in the form of a fine precipitated particle (made of carbide, nitride or oxide). Therefore, by supplying Ti to the surface or rust layers of the steel material from the outside and further incorporating Ti etc. into the composition of the steel material, the following effects may be exhibited: independent effect of Ti in the composition in the steel material or synergetic effect of promoting the generation of the dense and protective rust by combination of Ti from the outside and Ti in the composition in the steel material. Such effect is also exhibited by Nb, Ta, Zr, V or Hf other than Ti.

The steel material comprising Ti etc. in its surface or its inner part has the following advantage even if it is not subjected to any positive treatment. That is, in use thereof for fabrics such as a bridge, protective rust layers are generated for a relatively short time even in the chloride environment which is easily subjected to airborne salt from the sea or deicing salt. From the standpoint of ensuring corrosion resistance such as naked-state atomospheric corrosion resistance, however, the protective rust layers may be formed by positive treatment as follows: the steel material is produced and subsequently is subjected to optional pretreatment such as pickling and thermal treatment in the atmosphere of gas whose oxidization potential is controlled; or the steel material is subjected to chemical surface treatment with a chemical agent such as phosphate, chromate, or oxidizer to make the rust generated in the process for producing the steel material into an amorphous form.

Therefore, the subject steel material that element components in its surface are quantitatively measured or the amorphous degree in its rust is measured may be a steel material before use as an actual fabric, a steel material after use as a fabric, or a steel material subjected to an exposure test (in which salt water is sprayed 1 time per week).

The present invention can be used in order to improve not only steel material for new fabrics but also steel material, with or without painting, which is being used for a fabric which has already existed. That is, the surface of steel material which is being used as a fabric which has already existed is cleaned, without stripping or removing painted coating or rust on the surface, or with stripping painted coating or rust wholly or partially (for example, only corroded parts); and then the surface of the steel material is painted with an aqueous solution containing ions, fine particles or fine compounds of Ti etc. or an aqueous solution containing ions of Cr, Cu, P or Ni together with ions of Ti etc. by the above-mentioned chemical method. In this way, dense rust can be generated by the subsequent passage of time. The present invention can be therefore applied to repair or maintenance of fabrics that have already existed. In the present invention, the coating with the rust includes coating of the whole surface of steel, coating in which the coating amount is partially changed, coating in which a non-coating part is inevitably generated, and selective coating of only steel requiring corrosion resistance in a fabric. In the case that the steel material is used with painting, it is allowable that the above-mentioned solution (for example, titanium sulfate) is applied thereto and then the steel material is painted, or that the solution is dispersed in organic resin paint. The resin may be any oily or aqueous one. Examples thereof include acrylic, epoxy, urethane, polyester, and vinyl resins.

The following will describe the composition of the steel used in the present invention. From the standpoint of forming the protective rust, it is preferable that the steel used in the present invention does not contain any elements blocking the generation of the protective rust. The steel material of the present invention is for a fabric such as a small number main girder bridge. From the standpoint of construction efficency and shortening of a construction term, therefore, the steel material is subjected to large heat input welding at a heat input of 5 kJ/mm or more (at a heat input from 100 to 300 kJ/mm or more, as the case may be) by $CO_2$ arc shielded welding or electro-gas shielded arc welding. Thus, it is preferable that the steel material used in this fabric has sufficient mechanical properties such as strength suitable for a fabric, and excellent weldability and corrosion resistance permitting high-efficency welding, such as large heat input welding, without pre-heating.

In the light of this point, the steel used in the present invention does not include high alloy steels which do not permit the generation of rust in the chloride environment, but includes ordinary low carbon steels or low alloy steels which permit the generation of rust in the chloride environment. Conventional weathering steels containing P, Cu, Cr, Ni or the like may be used.

In severer requirements on corrosion resistance or severer chloride environments, elements blocking the generation of the protective rust, among all components of the steel, should be paid attention to. Such elements are S and Cr.

If S is contained in an amount of more than 0.02%, S is incorporated into the rust containing Ti etc., so as to block the generation of the protective rust layers. Thus, corrosion resistance may deteriorate. Preferably, therefore, the S content is set to 0.02% or less.

Cr, as well as P, Cu and Ni, is recognized to be an additive element essential for forming the protective rust layers in conventional weathering steel materials. As described above, Cr is contained in an amount of 0.30 to 1.25%, according to the JIS. JP-A-58-25458, U.S. Pat. No. 2,572,447 and the like do not disclose addition of Cr clearly. The steels however contain 0.05% or more of Cr inevitably as an impurity from iron raw material or an impurity incorporated in the step of producing the steels.

However, if only slight corrosion is generated in micro surface-defects in steel in the case that the steel contains 0.05% or more of Cr, Cr ions which follows iron atoms in a chemical equilibrium way and are slightly eluted from the steel cause a drop in pH inside the micro surface-defects of the steel, in particular in the environment in which Cl ions are present. This permits promotion of oxidization of condensed water inside the defects, so as to induce corrosion. Therefore, even if the dense and protective rust layers are generated, Cr has a function of promoting corrosion of the steel under the protective rust layers to block the adhesion between the rust layers and the steel. Thus, the exfoliation of the rust layers is promoted, to block the generation or maintenance of the dense and protective rust layers. Preferably, therefore, the Cr content in the steel is made as small as possible. From the economical standpoint point based on the reduction in the Cr content, the upper limit thereof is preferably 0.05%.

The steel preferably comprises Ti as an element for promoting the generation of the protective rust layers, instead of Cr. Ti, which is different from Cr, does not cause a drop in the above-mentioned pH. Ti in the steel has an effect of promoting the generation of the protective rust layers, and has such a peculiar property that the effect, by Ti in the rust layers, of promoting the generation of the protective rust layers is synergistically raised. Specifically, Ti has a function of raising the percentage of the amorphous species and $\alpha$-FeOOH in iron rust and suppressing the generation of $\beta$-FeOOH, which is a species promoting corrosion most easily among the crystalline rust species, to promote the generation of fine, dense and protective rust layers. As described above, such effects are exhibited in the form of Ti ions in the case of solved Ti, and in the form of fine precipitation of carbide, nitride or oxide in the case of non-solved Ti. As a result, invasion of corrosive factors such as chloride ions into the rust layers is blocked to keep the denseness of the protective rust layers. Thus, corrosion resistance is improved. If the Ti content is less than 0.01%, this effect is not exhibited. If the Ti content is more than 1.0%, the effect does not rise. In order to exhibit the effect of Ti more greatly, preferably 0.03% or more, and more preferably 0.05% or more of Ti is contained in the steel. If the Ti content in the steel is over 0.5%, the steel may be made brittle and is not economical. Therefore, in the case that Ti is contained in the steel, the Ti content is preferably from 0.03 to 1.0% and more preferably from 0.05 to 0.5%.

In Japanese Patent Application No. 9-330173, the inventors proposed the following steel as a steel in which the amounts of S and Cr blocking the generation of the protective rust are restricted and Ti promoting the generation of the protective rust is contained: a steel having a basic composition of C: 0.15% or less, Si: 0.10–1.0%, Mn: 1.5% or less, S: 0.02% or less, P: 0.05% or less, Cr: 0.05% or less, Ti: 0.01–1.0%, Ca: 0.0001–0.01%, one or two of Cu: 0.05–3.0% and Ni: 0.05–6.0%, and the balance being Fe and inevitable impurities. This steel is good in weldability, and is optimal as a preferred embodiment of the present invention.

The following elements (other than Ti) promoting the generation of the protective rust layers may be added to this basic composition: one or two of Mo: 0.05–3.0% and W: 0.05–3.0%, one or more of Al: 0.05–0.50%, La: 0.0001–0.05%, Ce: 0.0001–0.05% and Mg: 0.0001–0.05%, one or more of Zr, Ta, Nb, V and Hf: 0.50% or less (total amount). Zr, Ta, Nb, V and Hf have the effect of promoting the generation of the dense and protective rust layers in the form of metal ions in the case that they are solved, or in the form of fine precipitated particles in the case that they are not solved, in the same manner as Ti.

It is preferred for corrosion resistance that the steel has microstructural material of 90% or more of ferrite, or mixture microstructural material of ferrite and pearlite. Bainitic microstructural material or microstructural material of bainite and ferrite is preferred in order to keep strength or toughness of 500 N/mm$^2$ or more as fabric strength of a bridge and improve corrosion resistance of the steel itself.

The following will describe a method for producing the steel material of the present invention. The steel material of the present invention can be produced by the production method of thick steel plate usually having a thickness of 50 mm or more. That is, steel is melted by continues casting or an ingot-making method then is subjected to hot working such as blooming, hot forging, or thick plate rolling, so as to make the steel into a given thickness. The conditions of the hot working or the conditions of cooling or heat treatment after the hot working are appropriately decided according to, e.g., mechanical properties, such as strength, required as a fabric of a bridge (e.g., a strength of 390–630 N/mm$^2$, or a larger strength). Control rolling, or compulsion cooling such as acceleration cooling after the hot working, besides the usual hot working, may be applied in order to keep both a low alloy or carbon quantity for ensuring weldability and mechanical properties such as strength and make the microstructural material of the steel of the present invention into microstructural material of 90% or more of ferrite, mixture microstructural material of ferrite and pearlite, bainitic microstructural material or microstructural material of bainite and ferrite, or the like microstructural material. As the heat treatment after the hot working, direct quench (DQ) on rolling line, or quench and temper (QT) off line may be performed if necessary.

EXAMPLES

The significance of the above-mentioned respective requirements of the rust of the steel material of the present invention will be described by way of Examples.

Example 1

Steel lumps having chemical compositions shown in Table 1 were produced by melting. These steel lumps were hot-rolled and then forcibly cooled by acceleration cooling to produce thick steel plates having a thickness of 50 mm. Nos. 1, 2 and 3 in Table 1 are a low carbon steel, a Ti-containing weathering steel to be used with painting, and a Ti-containing weathering steel to be used without painting, respectively. Test pieces were sampled from these thick steel plates. The surfaces of the test pieces were made up to mirror faces by emery paper and buff polishing. The surfaces of the test pieces were painted with an aqueous solution of sulfate of Ti etc., or an aqueous solution of sulfate of Cr, Ni, Cu or P together with sulfate of Ti etc.

Test samples No. 3–12 in Table 1, among the test samples subjected to the above-mentioned processing, were used in a naked state which imitated use without painting, so as to perform corrosion resistance tests. Test samples Nos. 15–19 were used in the state that phthalic acid resin, which is usually used for painting bridges or the like, was applied (thickness: 50 $\mu$m). This imitated use with painting. The corrosion resistance test for the naked test pieces was an exposure test. 5% salt water was sprayed per week, which imitated an actual chloride environment. The test pieces were set towards the south and at an inclination of 30° to the horizontality. The term of the test was 15 months. Long-term endurance was evaluated by measurement of the thickness loss (corrosion loss) of the plate thickness. The thickness loss (mm) of the plate thickness was obtained by measuring a change in weights of the samples before and after the exposure test and then performing calculation with the consideration of density.

The reason why short-term corrosion resistance tests (e.g., a salt water spray test) were not performed and the long-term exposure test was performed is as follows. The steel material is used as e.g., a fabric for a bridge in the chloride environment. The long-term exposure test corresponds to corrosion under actual use-conditions of the steel material of the present invention.

Concerning the painted test pieces, their painted coating was beforehand injured to generate artificial coating defects. Moreover, the test pieces were subjected to an exposure test under the same conditions for the naked test pieces. Their corrosion resistance was evaluated by measuring the paint blister width of the artificial coating defects after the test. The results are shown in Table 2. In Table 2, the unit of the thickness loss is "mm". Concerning the paint blister width of the artificial coating defects, 0.80 mm or more, 0.5–0.8 mm, 0.5 mm or less, and substantial zero are described as A, B, C, and D, respectively.

Elements generated in the surface of the test samples after the exposure tests and the amounts of the elements were analyzed and measured by X-ray diffraction (XRD) and electron prove microanalysis (EPMA). The composition of rust was analyzed by X-ray diffraction. More specifically, according to X-ray diffraction disclosed in "Proceedings of Japan Society of Corrosion Engineering's Corrosion '95 Meeting 95C-306 (pp. 341–344)", rust samples collected from the steel materials were mixed with a given weight of ZnO as an internal standard substance to prepare powder. The powder was identified by X-ray diffraction. From integration intensity ratios of respective peculiar diffraction peaks of 4 kinds of crystalline rust components ($\alpha$-FeOOH, $\beta$-FeOOH, $\gamma$-FeOOH, and $Fe_3O_4$) and analytical curves of the respective rust which were beforehand obtained, the respective crystalline rust were quantitatively measured. The amounts of the respective crystalline rust were subtracted from the total amount of the rust to calculate the percentage (%) of the amorphous rust. These results are also shown in Table 2.

In Table 2, concerning the composition of the rust generated on the surface of the test pieces after the exposure test, the fraction of $\alpha$-FeOOH and the amorphous rust is shown as A (0–35wt %), B (35–40wt %) or C (40wt % or more). The fraction of $\beta$-FeOOH is shown as A (30 wt % or more), B (20–30 wt %) or C (less than 20 wt %). In Table 2, $\alpha$ and $\beta$ are abbreviations of $\alpha$-FeOOH and $\beta$-FeOOH, respectively.

For comparison, the following were analyzed and evaluated in the same manner for examples subjected to chemical treatment with an aqueous solution containing Ti etc.: test sample No. 1 which was not subjected to chemical treatment with an aqueous solution containing Ti etc., but was, in a naked form, subjected to the corrosion resistance test in the same manner for examples subjected to the same chemical treatment; and test samples Nos. 13 and 14 which were not subjected to the same chemical treatment but were, in a painted form, subjected to the corrosion resistance test in the same manner for examples subjected to the same chemical treatment. The results are also shown in Table 2.

As is evident from Table 2, test samples 3–12 and 15–19, which satisfied the requirements of the present invention, had satisfactory corrosion resistance in the cases with or without painting. The test sample No. 3 using Ti sulfate had better corrosion resistance than the test sample No. 4 using Ti chloride. This supports that the present invention steel using sulfate exhibits better corrosion resistance. This is because corrosion of the steel is promoted to generate rust (in particular, $\alpha$-FeOOH and amorphous rust) easily if an aqueous solution of a compound containing sulfuric ion is present. It can also be understood that the samples to which Zr, Cu or the like was added together with Ti had better corrosion resistance.

On the other hand, in the above-mentioned test samples 1 and 13 for comparison, their thickness loss was 0.80 mm or more, and their paint blister width was 0.80 mm or more (rank: A). Thus, their corrosion resistance was remarkably bad. In these comparative samples, their rust was made mainly of $\alpha$-FeOOH and the amorphous rust, but the rust contained none of Ti etc., or a small amount thereof so that the percentage (fraction) of crystalline $\beta$-FeOOH rust was large. The $\beta$-FeOOH functioned as a starting point for advancing corrosion. Thus, the corrosion resistance of the comparative samples was poor. It can be understood from these results that in order to make the rust on the surface of the steel into an amorphous state and suppress crystalline $\beta$-FeOOH rust, it is necessary to contain Ti etc. in the rust. In order to incorporate Ti etc. in the rust, the method of applying Ti sulfate or the like is excellent.

The concentration degree of chloride ion at the interface between the rust layer and the parent iron was measured by EPMA. The results demonstrate that the concentration degree was small in the test samples related to the present invention while the concentration degree was large in the comparative test samples. This supports the results of the above-mentioned corrosion resistance test.

Example 2

Figure 2:
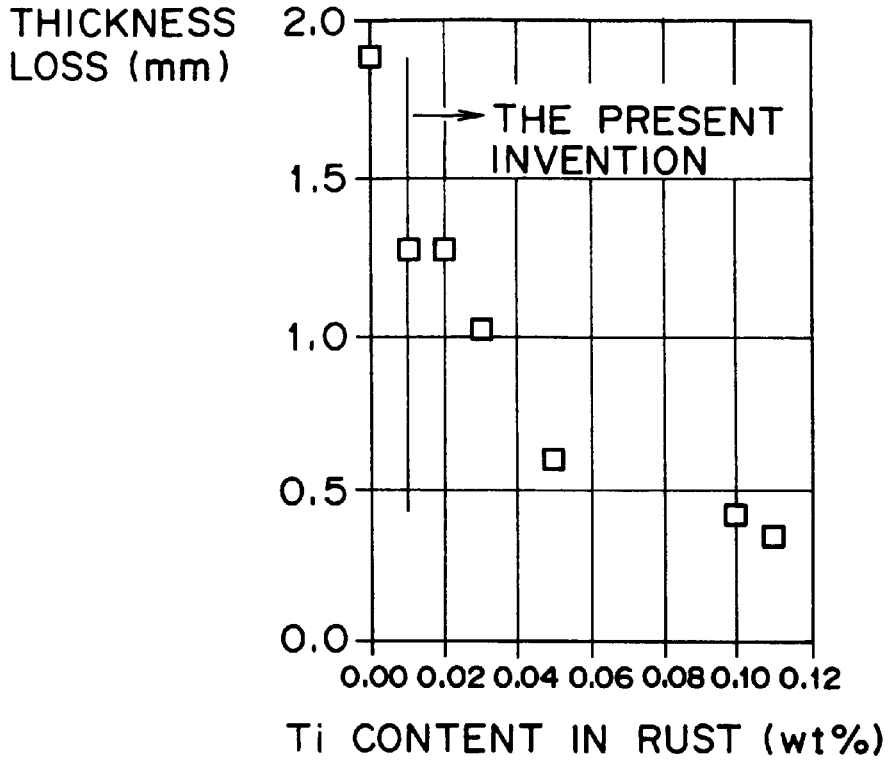
FIG. 2 is a graph showing the relationship between the Ti content (within a very small range) in rust, defined in the present invention, and thickness loss.

The low carbon steel shown in Table 1 was used to control only the Ti content in the rust by changing the concentrations of Ti sulfate of aqueous solutions for chemical treatment under the same conditions as in the test samples wherein its rust contained Ti in Example 1. In this way, test samples were prepared. The test pieces were subjected to an exposure test to measure the thickness loss of the plates. FIGS. 1 and 2 show the relationship between the Ti content in the generated rust and thickness loss of the plates. FIG. 2 shows the relationship about the range of very small amounts of Ti, that is, 0.12 wt % or less. As is understood from FIGS. 1 and 2, as the Ti content in the rust is larger, the thickness loss of the plates is smaller. The thickness loss is suddenly reduced in particular around 0.05 wt %. The requirement, defined in the present invention, that the content of Ti etc. in the rust is 0.05 wt % or more has critical significance as preferred conditions.

TABLE 1

Supplied materials

| No. | Components of steel (wt %) C | Si | Mn | P | S | Cu | Ni | Cr | Ti | Al | |
|---|---|---|---|---|---|---|---|---|---|---|---|
| 1 | 0.17 | 0.21 | 1.29 | 0.031 | 0.003 | — | — | — | — | 0.026 | mild steel |
| 2 | 0.05 | 0.35 | 1.46 | 0.010 | 0.003 | 0.55 | 0.30 | — | 0.05 | 0.026 | To be used with painting |
| 3 | 0.05 | 0.34 | 1.45 | 0.010 | 0.003 | 0.99 | — | — | 0.05 | 0.028 | To be used in a naked state |

TABLE 2

Test results

| Test sample No. | Steel No. | Components of coating solution | Elements of generated rust, and the contents thereof (wt %) | Composition of steel: Amorphous rust + α | β | Thickness loss after exposure (mm) | Paint blister width |
|---|---|---|---|---|---|---|---|
| 1 | 1 | No treatment | — | A | A | 1.90 | — |
| 2 | 3 | No treatment | Ti(0.10),Cu(2.01),Ni(1.59) | B | B | 0.56 | — |
| 3 | 3 | Ti sulfate | Ti(0.15),Cu(2.11),Ni(1.67) | C | C | 0.45 | — |
| 4 | 3 | Ti chloride | Ti(0.13),Cu(2.13),Ni(1.57) | C | C | 0.48 | — |
| 5 | 3 | Ti sulfate + V sulfate | Ti(0.15),Cu(2.05),Ni(1.34)V(0.5) | C | C | 0.39 | — |
| 6 | 3 | Ti sulfate + Nb sulfate | Ti(0.15),Cu(2.15),Ni(1.54),Nb(0.1) | C | C | 0.38 | — |
| 7 | 3 | Ti sulfate + Zr sulfate | Ti(0.15),Cu(2.25),Ni(1.64),Zr(0.08) | C | C | 0.34 | — |
| 8 | 3 | Ti sulfate + Cu sulfate | Ti(0.14),Cu(3.56),Ni(1.37) | C | C | 0.38 | — |
| 9 | 3 | Ti sulfate + Ni sulfate | Ti(0.15),Cu(2.08),Ni(2.98) | C | C | 0.37 | — |
| 10 | 3 | Ti sulfate + Cr sulfate | Ti(0.16),Cu(2.00),Ni(1.78),Cr(3.9) | C | C | 0.35 | — |
| 11 | 3 | Ti sulfate + Na phosphate | Ti(0.15),Cu(2.23),Ni(1.49),P(0.2) | C | C | 0.36 | — |
| 12 | 3 | Ti sulfate + Zr sulfate + Cu sulfate + Ni sulfate | Ti(0.16),Cu(3.85),Ni(2.54),Zr(0.1) | C | C | 0.32 | — |
| 13 | 1 | No treatment (coating) | — | — | — | — | A |
| 14 | 2 | No treatment (coating) | — | — | — | — | B |
| 15 | 2 | Ti sulfate (coating) | — | — | — | — | C |
| 16 | 2 | Ti chloride (coating) | — | — | — | — | C |
| 17 | 2 | Ti sulfate + Zr sulfate (coating) | — | — | — | — | D |
| 18 | 2 | Ti sulfate + Cu sulfate (coating) | — | — | — | — | D |
| 19 | 2 | Ti sulfate + Ni sulfate (coating) | — | — | — | — | D |

Example 3

In order to make clearer the relationship between the content of Ti etc. and thickness loss in the range that the content of Ti etc. in the rust is very small, that is, 0.1 wt % or less, in particular around the position where the thickness loss rises suddenly in Example 2 (FIGS. 1 and 2), an acceleration exposure test was performed about the range that the content of Ti etc. in the rust was very small. In this test, there were prepared test pieces in which only the Ti content in the rust was controlled by changing the concentration of Ti sulfate in aqueous solutions for chemical treatment, in the same manner as in Example 2; test pieces painted with blend solutions of various fine particles of carbide, nitride, and the like, such as TiC and TiN, present in the steels; and test pieces in which the concentration of Ti was controlled by adding fine particles such as TiC, TiN and $TiO_2$ in solutions of Ti sulfate. A corrosion resistance test was performed during 12 months under the same conditions as in Example 2, which imitated an actual salinity corrosion environment, except that 0.1% salt water was sprayed one time per week. The thickness loss of the plates after the test was measured.

Figure 3:
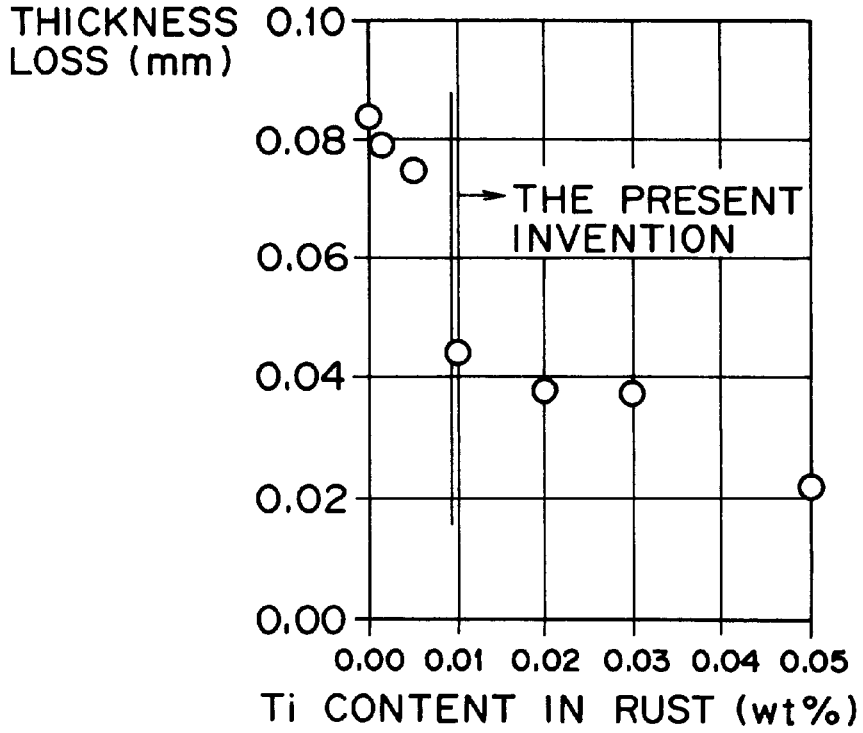
FIG. 3 is a graph showing the relationship between the Ti content (within a very small range) in rust, defined in the present invention, and thickness loss.

FIG. 3 shows the relationship between the Ti content in the generated rust and the thickness loss, based on the results. FIG. 3 shows the relationship about the range of very small amounts of Ti, that is, 0.05 wt % or less. As is understood from FIG. 3, as the Ti content in the rust is larger, the thickness loss is smaller in the same manner as shown in FIGS. 1 and 2. The thickness loss is suddenly reduced around 0.01 wt %. Therefore, it can be understood that when the salt water spray condition of the acceleration exposure test is milder than the conditions in Example 1 and 2, that is, when the chloride environment is milder, the content of Ti etc. in the rust can be reduced. (The amount of Ti can be selected according to the chloride environment). The requirement, defined in the present invention, that the content of Ti etc. in the rust is 0.01 wt % or more has critical significance.

Figure 4:
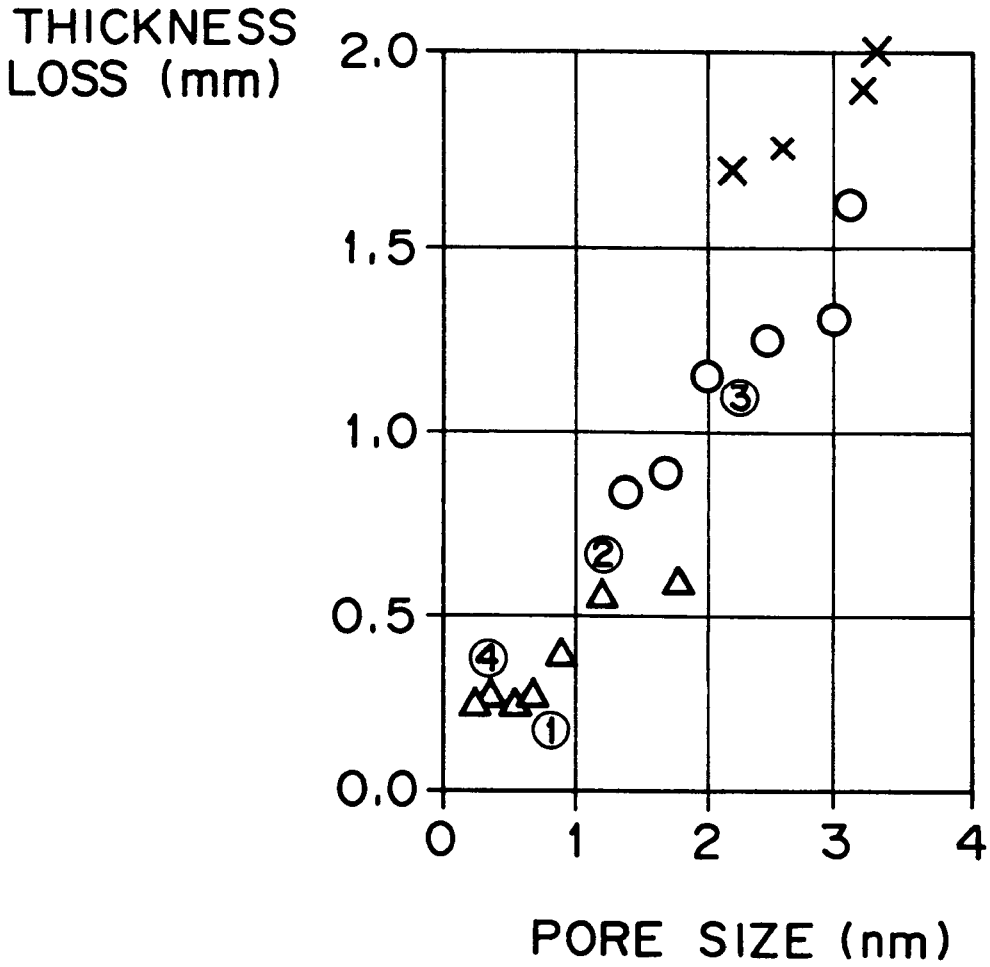
FIG. 4 is a graph showing the relationship between the pore size of rust, defined in the present invention, and thickness loss.

The test pieces having different Ti contents in the rusts, which were prepared in Example 3, were subjected to an acceleration exposure test under the conditions that 5.0% salt water was sprayed one time per week during 12 months. The pore size of the rusts in the respective test pieces after the test was measured by $N_2$ adsorption. FIG. 4 shows the relationship between the pore size and the thickness loss from this acceleration exposure test. Table 3 also shows the fractions of the amorphous rust plus α-FeOOH, and the fraction of β-FeOOH in the test pieces having the respective Ti contents. In FIG. 4, x, ○ and Δ represent the test pieces the Ti content of which was less than 0.01 wt %, 0.01–0.05 wt %, and more than 0.05 wt %, respectively. As is clear from FIG. 4, the pore size of the rust and the thickness loss are correlative. As the pore size is smaller, that is, the interval between rust grains is smaller, corrosion resistance is higher. As the Ti content is larger in the case that the test pieces have the same pore size, corrosion resistance is higher. It can be understood from these results that Ti in the rust makes the interval between the rust grains smaller to make the rust dense and improve corrosion resistance. It can also be understood from Table 3 that as the Ti content is larger, the fraction of the α-FeOOH and the amorphous rust is higher and the fraction of β-FeOOH is smaller. Thus, the fraction of the rust species and the Ti content is correlative. In FIG. 4, Δ to which ① is appended, Δ to which ② is appended and ⓪ to which ③ is appended, and Δ to which ④ is appended represent the test pieces the surfaces of which were coated with Ti by the following, respectively: painting a solution of Ti sulfate and an aqueous solution blended with a $TiO_2$ particles having an average particle size of 10 nm; painting aqueous solutions blended with TiC particles having average particle sizes of 20 nm and 30 nm, respectively; and painting an aqueous solution blended with TiC particles having an average particle sizes of 10 nm. Other Δ, ⓪ and x than the above represent the test pieces the surfaces of which were coated with Ti by a solution of Ti sulfate. It can be understood from the comparison of the test pieces to which ①–④ are appended that as the size of the particles is smaller in the case of painting the fine particles, corrosion resistance is more improved.

As is clear from the results of the above-mentioned Examples, the steel material of the present invention, with or without painting, has excellent corrosion resistance with good reproducibility. Thus, the steel material can be used for not only a bridge such as a small number main girder bridge but also ordinary fabrics such as an iron tower for transmission of electricity, and buildings. Moreover, ordinary carbon steel and low alloy steel can be used as steels having higher corrosion resistance than weathering steel. The present invention can exhibit good properties of ordinary carbon steel and low alloy steel, such as good weldability and mechanical properties.

TABLE 3

| Ti content in rust (%) | Amorphous rust + α | β |
|---|---|---|
| x < 0.01 | A | A |
| ○ .01–0.05 | B | B |
| Δ > 0.05 | C | C |

What is claimed is:

1. A steel material excellent in corrosion resistance, the surface of which is coated with rust comprising one or more selected from Ti, Nb, Ta, Zr, V and Hf in the total amount of 0.01 wt % or more, in which the fraction of α-FeOOH and an amorphous rust is 35 wt % or more, the fraction of β-FeOOH is 20 wt % or less, and each of the fractions is measured by X-ray diffraction.

2. A steel material according to claim 1, wherein the rust comprises Ti.

3. A steel material according to claim 1, wherein the total amount of Ti, Nb, Ta, Zr, V and Hf is 0.1 wt % or more.

4. A steel material according to claim 1, wherein at least one part of Ti, Nb, Ta, Zr, V and Hf is present in the form of fine particles.

5. A steel material according to claim 3, which further comprises one or more selected from Cr, Ni, Cu and P in the total amount of 0.3 wt % or more.

6. A steel material according to claim 1, wherein the rust has pores and the size of the pores is 3 nm or less.

7. A steel material excellent in corrosion resistance, the surface of which is coated with the rust defined in claim 1, comprising C: 0.15 wt % or less, Si: 0.10–1.0 wt %, Mn: 1.5 wt % or less, S: 0.02 wt % or less, P: 0.05 wt % or less, Cr: 0.05 wt % or less, Ti: 0.01–1.0 wt %, Ca: 0.0001–0.01 wt %, one or two of Cu: 0.05–3.0 wt % and Ni: 0.05–6.0 wt %, and the balance being Fe and inevitable impurities.

8. A fabric prepared from the material of claim 1.

9. A steel material excellent in corrosion resistance, the surface of which is coated with rust comprising one or more selected from Ti, Nb, Ta, Zr, V and Hf in the total amount of 0.05 wt % or more, in which the fraction of α-FeOOH and an amorphous rust is 35 wt % or more, the fraction of β-FeOOH is 20 wt % or less, and each of the fractions is measured by X-ray diffraction.

10. A steel material according to claim 9, wherein the rust comprises Ti.

11. A steel material according to claim 9, wherein the total amount of Ti, Nb, Ta, Zr, V and Hf is 0.1 wt % or more.

12. A steel material according to claim 9, wherein at least one part of Ti, Nb, Ta, Zr, V and Hf is present in the form of fine particles.

13. A steel material according to claim 11, which further comprises one or more selected from Cr, Ni, Cu and P in the total amount of 0.3 wt % or more.

14. A steel material according to claim 9, wherein the rust has pores and the size of the pores is 3 nm or less.

15. A steel material excellent in corrosion resistance, the surface of which is coated with the rust defined in claim 9, comprising C: 0.15 wt % or less, Si: 0.10–1.0 wt %, Mn: 1.5 wt % or less, S: 0.02 wt % or less, P: 0.05 wt % or less, Cr: 0.05 wt % or less, Ti: 0.01–1.0 wt %, Ca: 0.0001–0.01 wt %, one or two of Cu: 0.05–3.0 wt % and Ni: 0.05–6.0 wt %, and the balance being Fe and inevitable impurities.

16. A fabric prepared from the material of claim 9.

* * * * *